US010160213B2

(12) United States Patent
Chen et al.

(10) Patent No.: US 10,160,213 B2
(45) **Date of Patent: *Dec. 25, 2018**

(54) MOLDED FLUID FLOW STRUCTURE

(71) Applicant: HEWLETT-PACKARD DEVELOPMENT COMPANY, L.P., Houston, TX (US)

(72) Inventors: Chien-Hua Chen, Corvallis, OR (US); Michael W. Cumbie, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/872,484

(22) Filed: Jan. 16, 2018

(65) Prior Publication Data

US 2018/0141337 A1 May 24, 2018

Related U.S. Application Data

(63) Continuation of application No. 14/769,994, filed as application No. PCT/US2013/028207 on Feb. 28, 2013, now Pat. No. 9,944,080.

(51) Int. Cl.
*B41J 2/155* (2006.01)
*B41J 2/14* (2006.01)
(Continued)

(52) U.S. Cl.
CPC ..... *B41J 2/155* (2013.01); *B41J 2/14* (2013.01); *B41J 2/1404* (2013.01); *B41J 2/145* (2013.01);
(Continued)

(58) Field of Classification Search
CPC ..... B41J 2/1433
See application file for complete search history.

(56) References Cited

U.S. PATENT DOCUMENTS 4,633,274 A 12/1986 Matsuda
4,873,622 A 10/1989 Komuro et al.
(Continued)

FOREIGN PATENT DOCUMENTS

CN 1297815 A 6/2001
CN 101607477 A 12/2009
(Continued)

OTHER PUBLICATIONS

Kumar, Aditya, et al; "Wafer Level Embedding Technology for 3D Wafer Level Embedded Package"; Institute of Microelectronics, A*Star; 2Kingergy Ltd., TECHplace II; 2009; Electronic Components and Technology Conference.
(Continued)

*Primary Examiner* — Julian D Huffman
*Assistant Examiner* — Michael Konczal

(57) ABSTRACT

A fluid flow structure may include a micro device embedded in a monolithic molding. The molding may include a channel therein through which fluid flows directly into the micro device. The micro device may include a fluid flow passage connected directly to the channel, a silicon substrate, and a fluid port formed in the silicon substrate and fluidically coupled to the channel. A fluid is feedable through the fluid port. The channel is wider than the fluid port. The channel includes an open channel exposed to an external surface of the micro device.

20 Claims, 17 Drawing Sheets

(51) Int. Cl.
*B41J 2/16* (2006.01)
*B41J 2/145* (2006.01)
*B41J 25/34* (2006.01)

(52) U.S. Cl.
CPC ..... *B41J 2/1433* (2013.01); *B41J 2/14129* (2013.01); *B41J 2/14145* (2013.01); *B41J 2/14201* (2013.01); *B41J 2/1603* (2013.01); *B41J 2/1607* (2013.01); *B41J 2/1637* (2013.01); *B41J 25/34* (2013.01); *B41J 2002/14419* (2013.01); *B41J 2202/20* (2013.01)

(56) References Cited

U.S. PATENT DOCUMENTS

| | | | | |
|---|---|---|---|---|
| 6,145,965 | A | 11/2000 | Inada et al. | |
| 6,250,738 | B1 | 6/2001 | Waller et al. | |
| 6,554,399 | B2 | 4/2003 | Wong et al. | |
| 6,560,871 | B1 | 5/2003 | Ramos | |
| 7,188,942 | B2 | 3/2007 | Haines | |
| 7,490,924 | B2 | 2/2009 | Haluzak et al. | |
| 7,591,535 | B2 | 9/2009 | Nystrom et al. | |
| 7,658,470 | B1 | 2/2010 | Jones et al. | |
| 7,824,013 | B2 | 11/2010 | Chung-Long et al. | |
| 7,828,417 | B2 * | 11/2010 | Haluzak | B41J 2/16 347/49 |
| 7,877,875 | B2 | 2/2011 | O'Farrell et al. | |
| 8,235,500 | B2 | 8/2012 | Nystrom et al. | |
| 8,246,141 | B2 | 8/2012 | Petruchik et al. | |
| 8,272,130 | B2 | 9/2012 | Miyazaki | |
| 8,287,104 | B2 | 10/2012 | Sharan et al. | |
| 8,342,652 | B2 | 1/2013 | Nystrom et al. | |
| 2001/0037808 | A1 | 11/2001 | Deem | |
| 2002/0180825 | A1 | 12/2002 | Buswell et al. | |
| 2003/0186474 | A1 | 10/2003 | Haluzak | |
| 2004/0032468 | A1 | 2/2004 | Killmeier et al. | |
| 2005/0024444 | A1 * | 2/2005 | Conta | B41J 2/1404 347/65 |
| 2006/0066674 | A1 | 3/2006 | Sugahara | |
| 2006/0132543 | A1 | 6/2006 | Elrod et al. | |
| 2007/0153070 | A1 | 7/2007 | Haines et al. | |
| 2008/0079781 | A1 | 4/2008 | Shim et al. | |
| 2008/0259125 | A1 | 10/2008 | Haluzak et al. | |
| 2009/0225131 | A1 | 9/2009 | Chen et al. | |
| 2010/0271445 | A1 | 10/2010 | Sharan et al. | |
| 2011/0019210 | A1 | 1/2011 | Chung et al. | |
| 2011/0037808 | A1 | 2/2011 | Ciminelli | |
| 2011/0080450 | A1 | 4/2011 | Ciminelli et al. | |
| 2011/0141691 | A1 | 6/2011 | Slaton et al. | |
| 2011/0222239 | A1 | 9/2011 | Dede | |
| 2011/0292126 | A1 | 12/2011 | Nystrom et al. | |
| 2011/0298868 | A1 | 12/2011 | Fielder et al. | |
| 2012/0019593 | A1 | 1/2012 | Scheffelin et al. | |
| 2012/0124835 | A1 | 5/2012 | Okano et al. | |
| 2012/0186079 | A1 | 7/2012 | Ciminelli | |
| 2012/0210580 | A1 | 8/2012 | Dietl | |
| 2012/0212540 | A1 | 8/2012 | Dietl | |
| 2016/0009084 | A1 * | 1/2016 | Chen | B41J 2/155 347/44 |

FOREIGN PATENT DOCUMENTS

| | | | |
|---|---|---|---|
| CN | 102470672 | A | 5/2012 |
| EP | 1095773 | | 5/2001 |
| JP | H11-20800 | | 8/1999 |
| JP | 2001071490 | | 3/2001 |
| JP | 2000108360 | | 4/2001 |
| JP | 2004-517755 | | 6/2004 |
| JP | 2006321222 | | 11/2006 |
| JP | 2010137460 | | 6/2010 |
| JP | 2013-501655 | | 1/2013 |
| KR | 2004-0097848 | | 11/2004 |
| TW | 200936385 | A | 9/2009 |
| TW | 201144081 | A | 12/2011 |
| WO | WO-2010/005434 | A1 | 1/2010 |
| WO | WO-2012134480 | | 10/2012 |

OTHER PUBLICATIONS

Lee, J-D, et al; "A Thermal Inkjet Printhead with a Monolithically Fabricated Nozzle Plate and Self-Aligned Ink Feed Hole"; http://ieeexplore.ieee.org/stamp/stamp.jsp?tp=&arnumber=788625; on pp. 229-236; vol. 8; Issue 3; Sep. 1999.

Lindemann, T., et al; "One Inch Thermal Bubble Jet Printhead with Laser Structured Integrated Polyimide Nozzle Plate"; http://ieeexplore.ieee.org/stamp/stampt.jsp?tp=arnumber=4147592; on pp. 420-428; vol. 16, Issue 2; Apr. 2007.

* cited by examiner

MOLDED FLUID FLOW STRUCTURE

RELATED DOCUMENTS

The present application is a continuation and claims the benefit under 35 U.S.C. § 120, of U.S. application Ser. No. 14/769,994, filed Aug. 24, 2015, which claims benefit under 35 U.S.C. § 371 and is the National Stage Entry of International Application No. PCT/US2013/028207, filed Feb. 28, 2013. These applications are herein incorporated by reference in their entireties.

BACKGROUND

Each printhead die in an inkjet pen or print bar includes tiny channels that carry ink to the ejection chambers. Ink is distributed from the ink supply to the die channels through passages in a structure that supports the printhead die(s) on the pen or print bar. It may be desirable to shrink the size of each printhead die, for example to reduce the cost of the die and, accordingly, to reduce the cost of the pen or print bar. The use of smaller dies, however, can require changes to the larger structures that support the dies, including the passages that distribute ink to the dies.

DRAWINGS

Each pair of FIGS. 1/2, 3/4, 5/6, and 7/8 illustrate one example of a new molded fluid flow structure in which a micro device is embedded in a molding with a fluid flow path directly to the device.

The same part numbers designate the same or similar parts throughout the figures. The figures are not necessarily to scale. The relative size of some parts is exaggerated to more clearly illustrate the example shown.

DESCRIPTION

Figure 1:
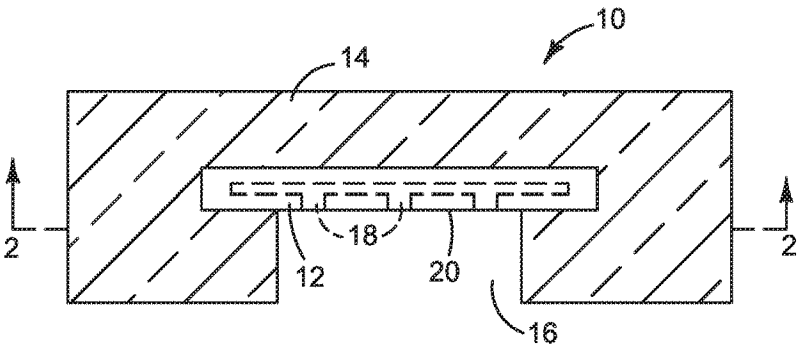

Inkjet printers that utilize a substrate wide print bar assembly have been developed to help increase printing speeds and reduce printing costs. Conventional substrate wide print bar assemblies include multiple parts that carry printing fluid from the printing fluid supplies to the small printhead dies from which the printing fluid is ejected on to the paper or other print substrate. While reducing the size and spacing of the printhead dies continues to be important for reducing cost, channeling printing fluid from the larger supply components to ever smaller, more tightly spaced dies requires complex flow structures and fabrication processes that can actually increase cost.

A new fluid flow structure has been developed to enable the use of smaller printhead dies and more compact die circuitry to help reduce cost in substrate wide inkjet printers. A print bar implementing one example of the new structure includes multiple printhead dies molded into an elongated, monolithic body of moldable material. Printing fluid channels molded into the body carry printing fluid directly to printing fluid flow passages in each die. The molding in effect grows the size of each die for making external fluid connections and for attaching the dies to other structures, thus enabling the use of smaller dies. The printhead dies and printing fluid channels can be molded at the wafer level to form a new, composite printhead wafer with built-in printing fluid channels, eliminating the need to form the printing fluid channels in a silicon substrate and enabling the use of thinner dies.

The new fluid flow structure is not limited to print bars or other types of printhead structures for inkjet printing, but may be implemented in other devices and for other fluid flow applications. Thus, in one example, the new structure includes a micro device embedded in a molding having a channel or other path for fluid to flow directly into or onto the device. The micro device, for example, could be an electronic device, a mechanical device, or a microelectromechanical system (MEMS) device. The fluid flow, for example, could be a cooling fluid flow into or onto the micro device or fluid flow into a printhead die or other fluid dispensing micro device.

These and other examples shown in the figures and described below illustrate but do not limit the invention, which is defined in the Claims following this Description.

As used in this document, a "micro device" means a device having one or more exterior dimensions less than or equal to 30 mm; "thin" means a thickness less than or equal to 650 μm; a "sliver" means a thin micro device having a ratio of length to width (L/W) of at least three; a "printhead" and a "printhead die" mean that part of an inkjet printer or other inkjet type dispenser that dispenses fluid from one or more openings. A printhead includes one or more printhead dies, "printhead" and "printhead die" are not limited to printing with ink and other printing fluids but also include inkjet type dispensing of other fluids and/or for uses other than printing.

Figure 2:
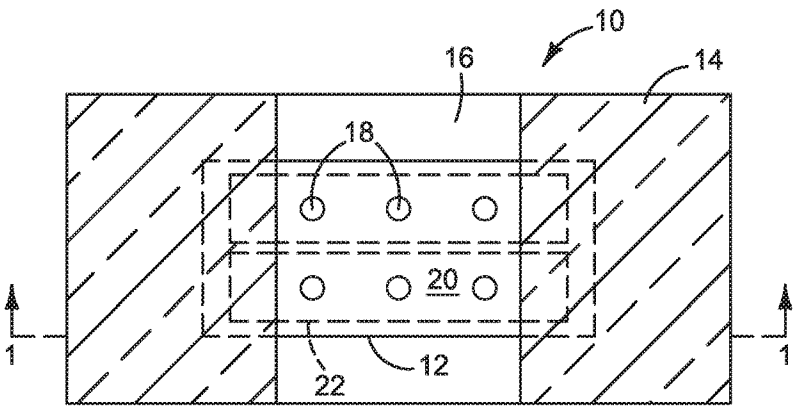

FIGS. 1 and 2 are elevation and plan section views, respectively, illustrating one example a new fluid flow structure 10. Referring to FIGS. 1 and 2, structure 10 includes a micro device 12 molded into in a monolithic body 14 of plastic or other moldable material. A molded body 14 is also referred to herein as a molding 14. Micro device 12, for example, could be an electronic device, a mechanical device, or a microelectromechanical system (MEMS) device. A channel or other suitable fluid flow path 16 is molded into body 14 in contact with micro device 12 so that fluid in channel 16 can flow directly into or onto device 12 (or both). In this example, channel 16 is connected to fluid flow passages 18 in micro device 12 and exposed to exterior surface 20 of micro device 12.

Figure 3:
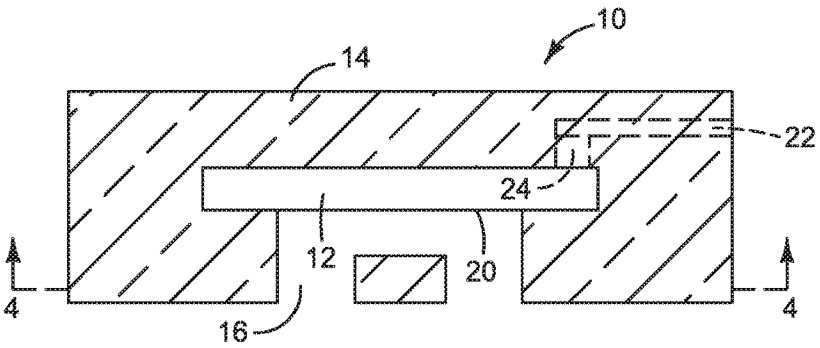
Figure 4:
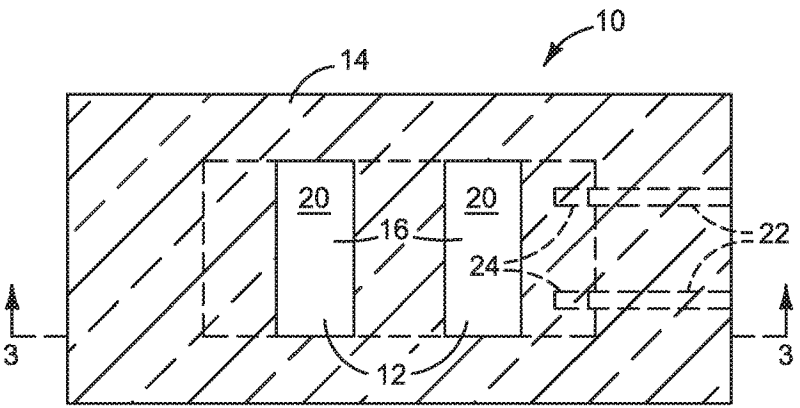
Figure 5:
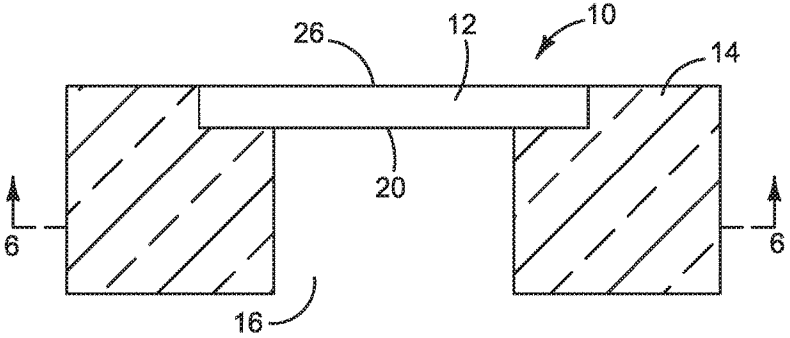
Figure 6:
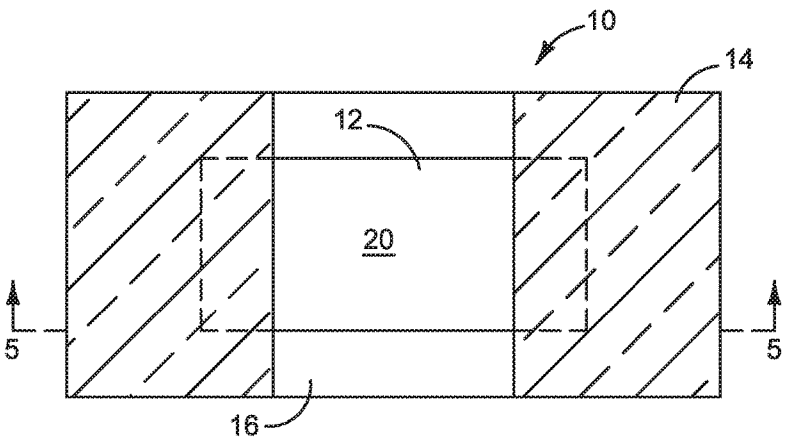
Figure 7:
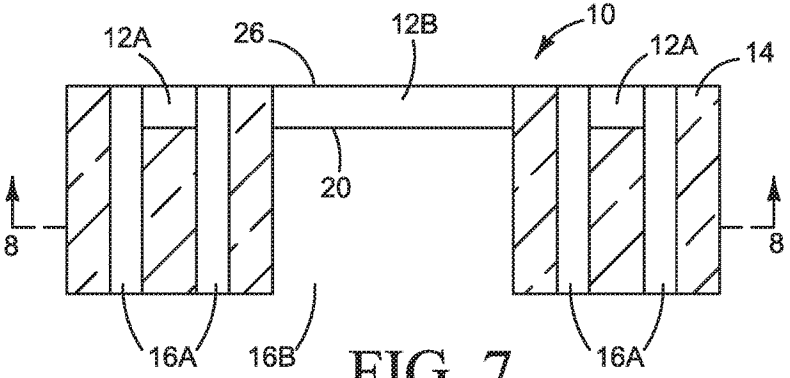
Figure 8:
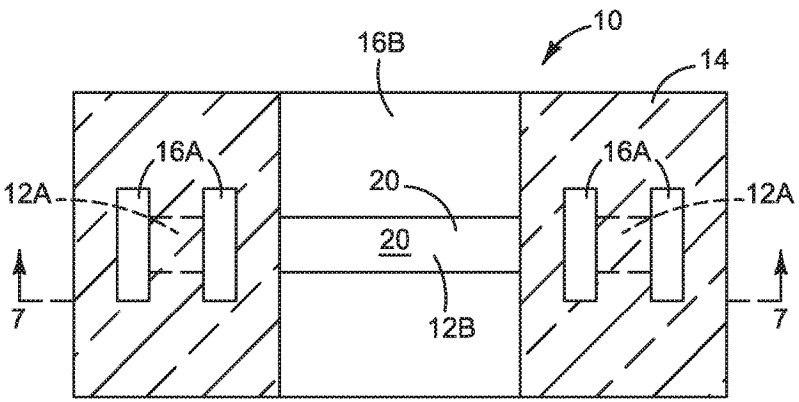

In another example, shown in FIGS. 3 and 4, flow path 16 in molding 14 allows air or other fluid to flow along an exterior surface 20 of micro device 12, for instance to cool device 12. Also, in this example, signal traces or other conductors 22 connected to device 12 at electrical terminals 24 are molded into molding 14. In another example, shown in FIGS. 5 and 6, micro device 12 is molded into body 14 with an exposed surface 26 opposite channel 16. In another example, shown in FIGS. 7 and 8, micro devices 12A and 12B are molded into body 14 with fluid flow channels 16A and 16B. In this example, flow channels 16A contact the edges of outboard devices 12A while flow channel 16B contacts the bottom of inboard device 12B.

Figure 9:
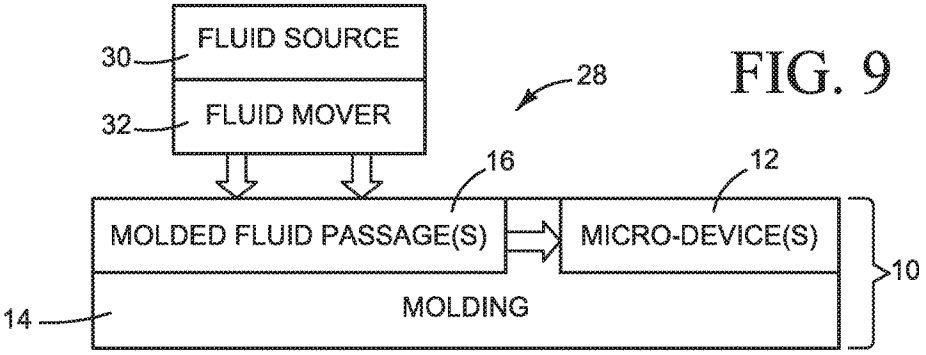
FIG. 9 is a block diagram illustrating a fluid flow system implementing a new fluid flow structure such as one of the examples shown in FIGS. 1-8.

FIG. 9 is a block diagram illustrating a system 28 implementing a new fluid flow structure 10 such as one of the flow structures 10 shown in FIGS. 1-8. Referring to FIG. 9, system 28 includes a fluid source 30 operatively connected to a fluid mover 32 configured to move fluid to flow path 16 in structure 10. A fluid source 30 might include, for example, the atmosphere as a source of air to cool an electronic micro device 12 or a printing fluid supply for a printhead micro device 12. Fluid mover 32 represents a pump, a fan, gravity or any other suitable mechanism for moving fluid from source 30 to flow structure 10.

Figure 10:
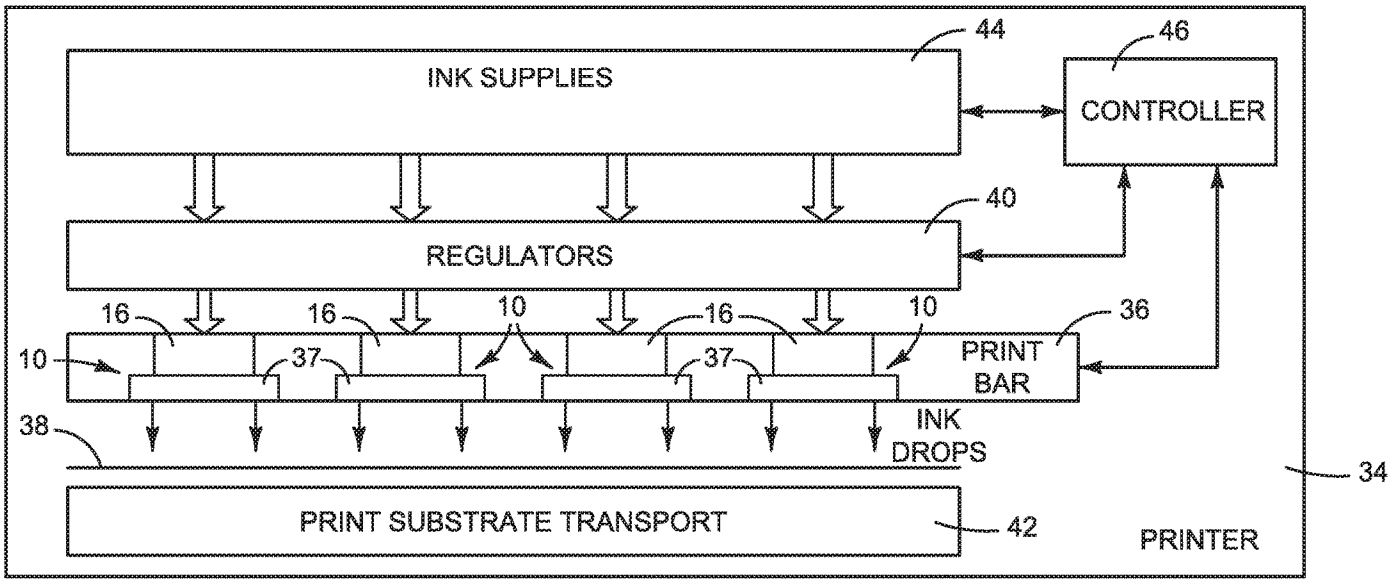
FIG. 10 is a block diagram illustrating an inkjet printer implementing one example of a new fluid flow structure for the printheads in a substrate wide print bar.

FIG. 10 is a block diagram illustrating an inkjet printer 34 implementing one example of a new fluid flow structure 10 in a substrate wide print bar 36. Referring to FIG. 10, printer 34 includes print bar 36 spanning the width of a print substrate 38, flow regulators 40 associated with print bar 36, a substrate transport mechanism 42, ink or other printing fluid supplies 44, and a printer controller 46. Controller 46 represents the programming, processor(s) and associated memories, and the electronic circuitry and components needed to control the operative elements of a printer 10. Print bar 36 includes an arrangement of printheads 37 for dispensing printing fluid on to a sheet or continuous web of paper or other print substrate 38. As described in detail below, each printhead 37 includes one or more printhead dies in a molding with channels 16 to feed printing fluid directly to the die(s). Each printhead die receives printing fluid through a flow path from supplies 44 into and through flow regulators 40 and channels 16 in print bar 36.

FIGS. 11-16 illustrate an inkjet print bar 36 implementing one example of a new fluid flow structure 10, such as might be used in printer 34 shown in FIG. 10. Referring first to the plan view of FIG. 11, printheads 37 are embedded in an elongated, monolithic molding 14 and arranged generally end to end in rows 48 in a staggered configuration in which the printheads in each row overlap another printhead in that row. Although four rows 48 of staggered printheads 37 are shown, for printing four different colors for example, other suitable configurations are possible.

Figure 11:
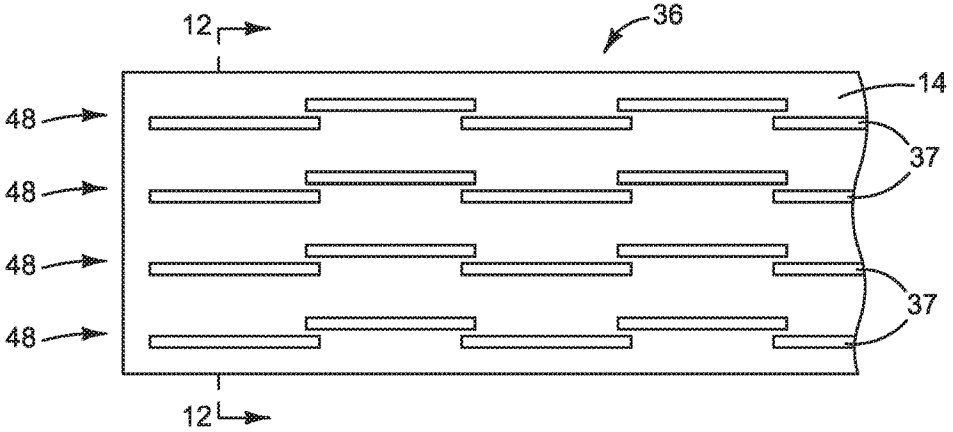
FIGS. 11-16 illustrate an inkjet print bar implementing one example of a new fluid flow structure for a printhead die, such as might be used in the printer of FIG. 10.
Figure 12:
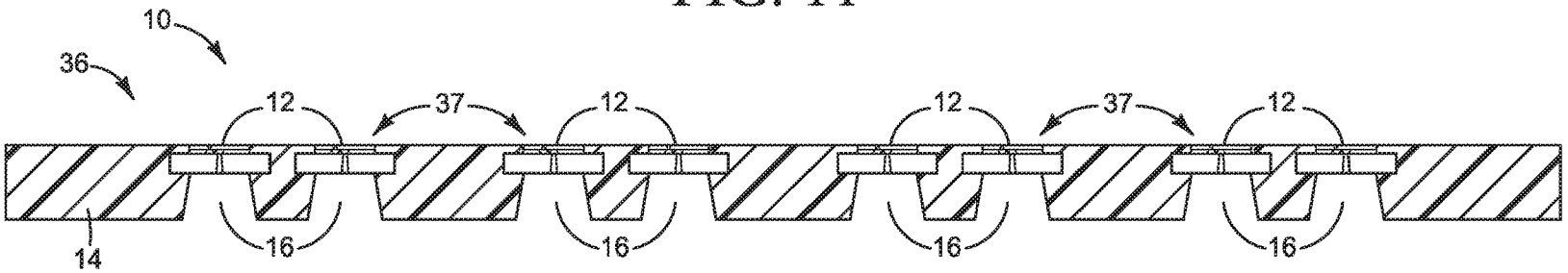
Figure 13:
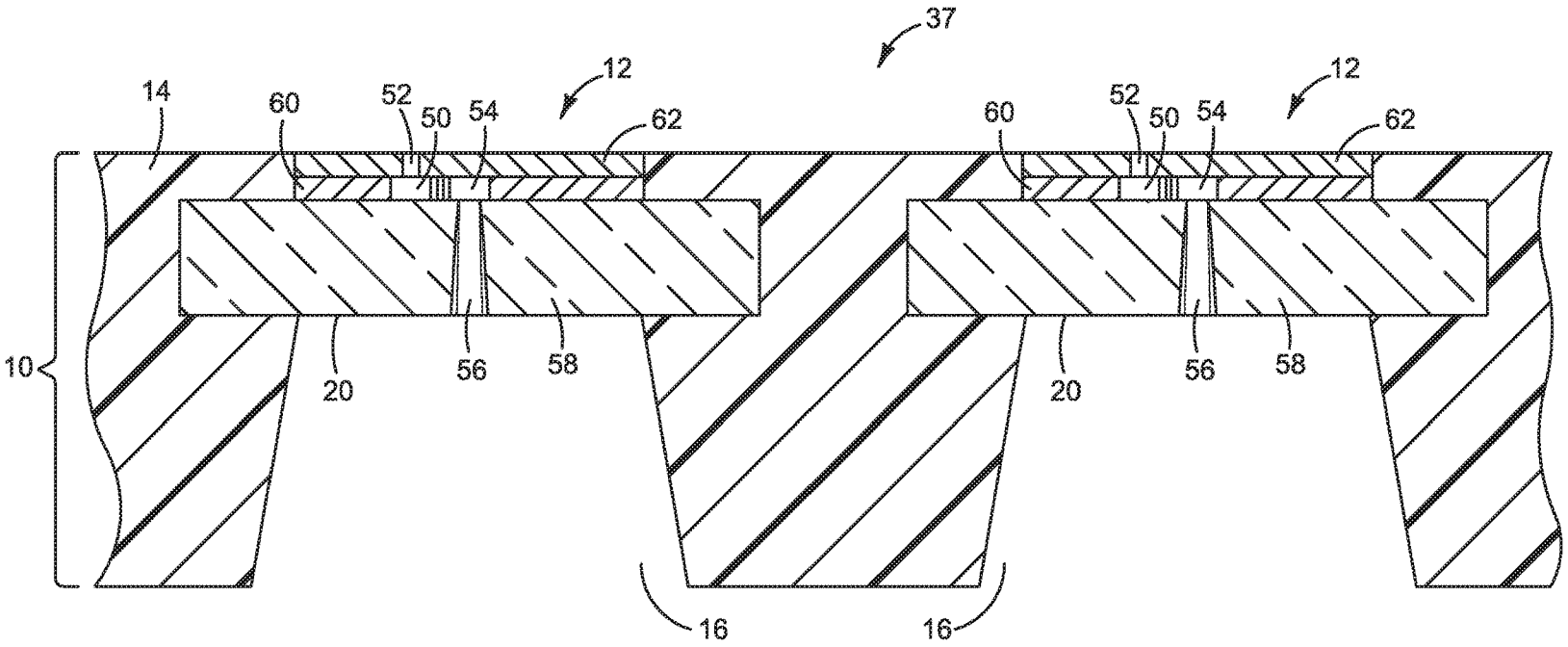
Figure 14:
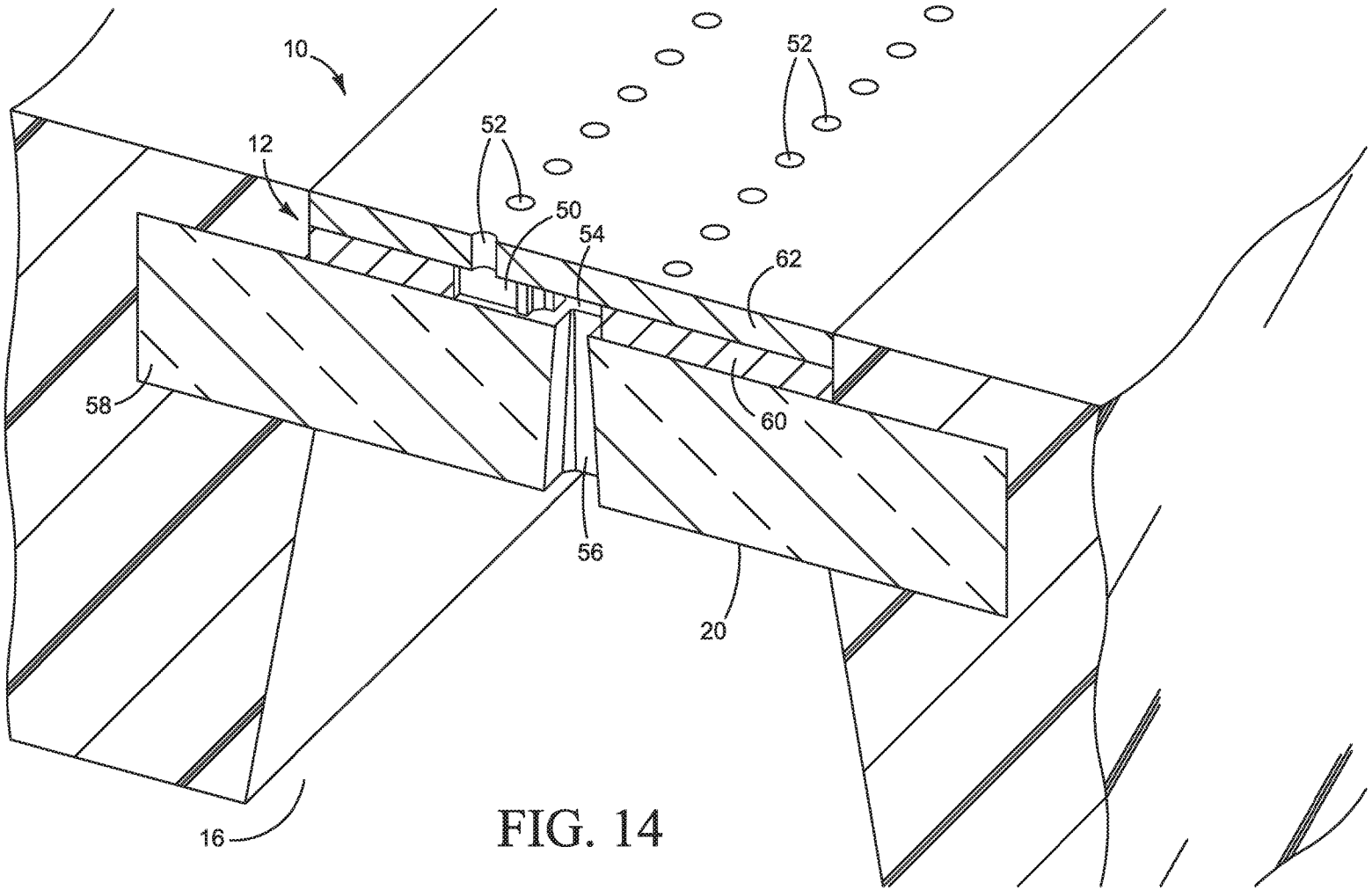
Figure 15:
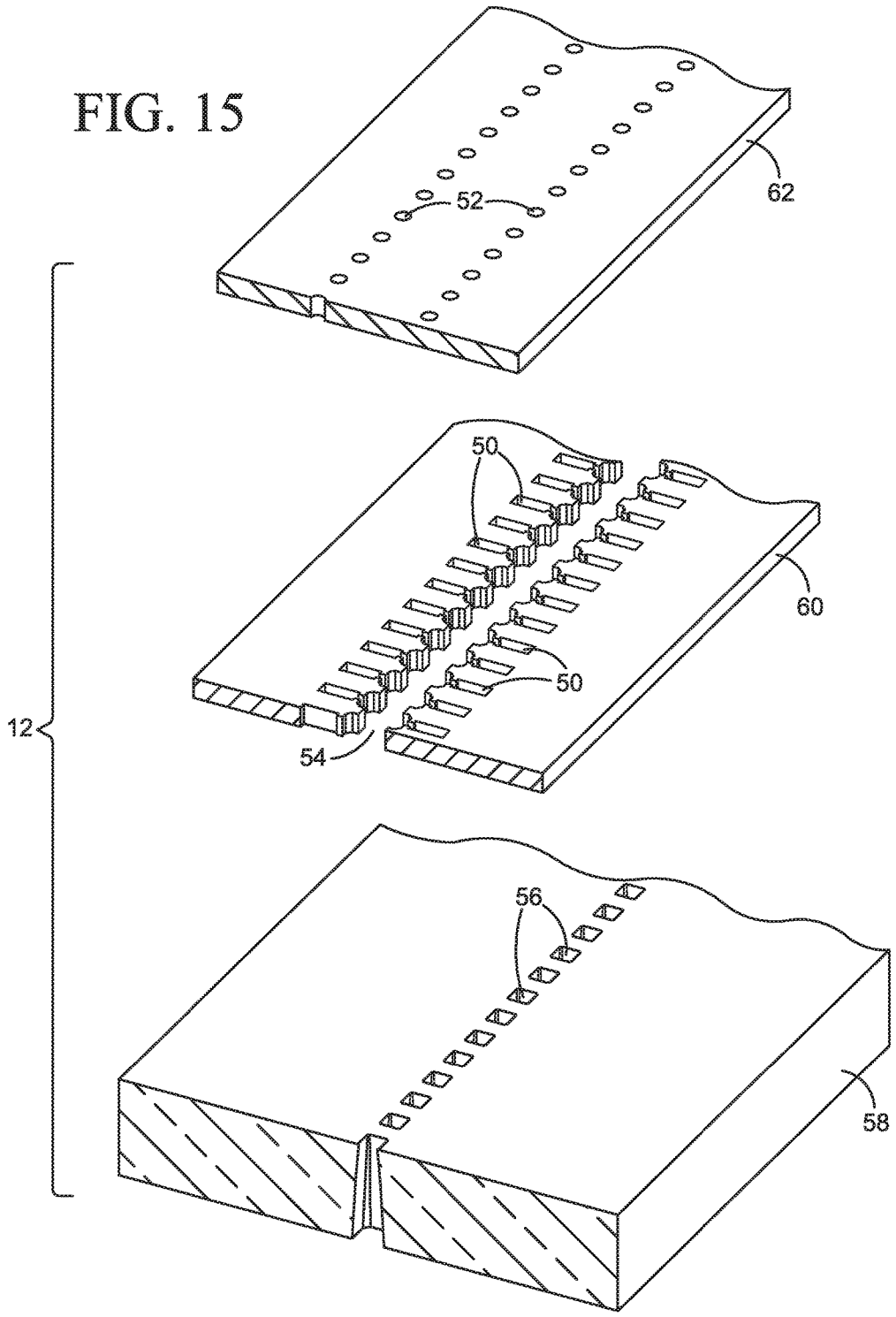
Figure 16:
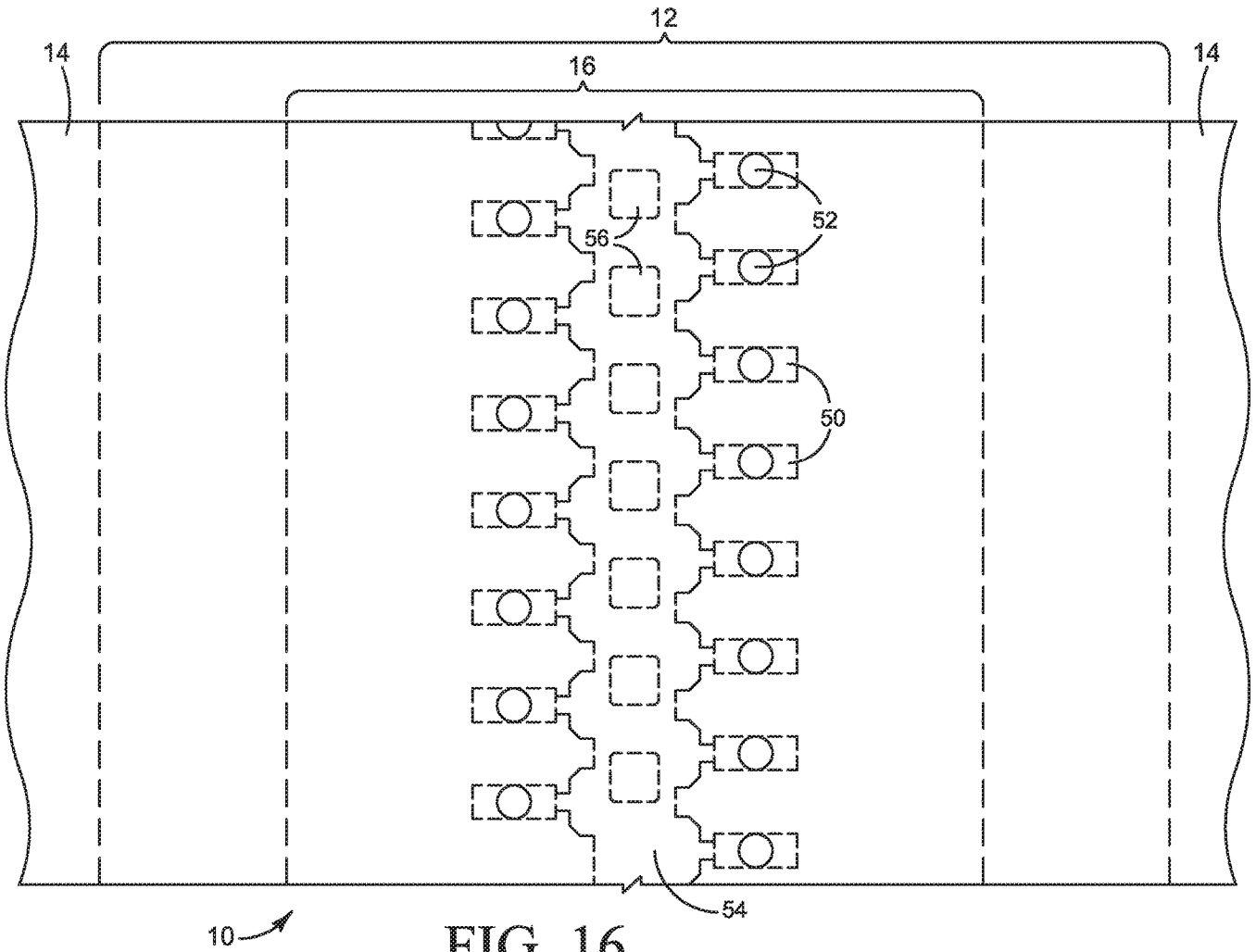

FIG. 12 is a section view taken along the line 12-12 in FIG. 11. FIGS. 13-15 are detail views from FIG. 12, and FIG. 16 is a plan view diagram showing the layout of some of the features of printhead die flow structure 10 in FIGS. 12-14. Referring now to FIGS. 11-15, in the example shown, each printhead 37 includes a pair of printhead dies 12 each with two rows of ejection chambers 50 and corresponding orifices 52 through which printing fluid is ejected from chambers 50. Each channel 16 in molding 14 supplies printing fluid to one printhead die 12. Other suitable configurations for printhead 37 are possible. For example, more or fewer printhead dies 12 may be used with more or fewer ejection chambers 50 and channels 16. (Although print bar 36 and printheads 37 face up in FIGS. 12-15, print bar 36 and printheads 37 usually face down when installed in a printer, as depicted in the block diagram of FIG. 10.)

Printing fluid flows into each ejection chamber 50 from a manifold 54 extending lengthwise along each die 12 between the two rows of ejection chambers 50. Printing fluid feeds into manifold 54 through multiple ports 56 that are connected to a printing fluid supply channel 16 at die surface 20. Printing fluid supply channel 16 is substantially wider than printing fluid ports 56, as shown, to carry printing fluid from larger, loosely spaced passages in the flow regulator or other parts that carry printing fluid into print bar 36 to the smaller, tightly spaced printing fluid ports 56 in printhead die 12. Thus, printing fluid supply channels 16 can help reduce or even eliminate the need for a discrete "fan-out" and other fluid routing structures necessary in some conventional printheads. In addition, exposing a substantial area of printhead die surface 20 directly to channel 16, as shown, allows printing fluid in channel 16 to help cool die 12 during printing.

The idealized representation of a printhead die 12 in FIGS. 11-15 depicts three layers 58, 60, 62 for convenience only to clearly show ejection chambers 50, orifices 52, manifold 54, and ports 56. An actual inkjet printhead die 12 is a typically complex integrated circuit (IC) structure formed on a silicon substrate 58 with layers and elements not shown in FIGS. 11-15. For example, a thermal ejector element or a piezoelectric ejector element formed on substrate 58 at each ejection chamber 50 is actuated to eject drops or streams of ink or other printing fluid from orifices 52.

A molded flow structure 10 enables the use of long, narrow and very thin printhead dies 12. For example, it has been shown that a 100 μm thick printhead die 12 that is about 26 mm long and 500 μm wide can be molded into a 500 μm thick body 14 to replace a conventional 500 μm thick silicon printhead die. Not only is it cheaper and easier to mold channels 16 into body 14 compared to forming the feed channels in a silicon substrate, but it is also cheaper and easier to form printing fluid ports 56 in a thinner die 12. For example, ports 56 in a 100 μm thick printhead die 12 may be formed by dry etching and other suitable micromachining techniques not practical for thicker substrates. Micromachining a high density array of straight or slightly tapered through ports 56 in a thin silicon, glass or other substrate 58 rather than forming conventional slots leaves a stronger substrate while still providing adequate printing fluid flow. Tapered ports 56 help move air bubbles away from manifold 54 and ejection chambers 50 formed, for example, in a monolithic or multi-layered orifice plate 60/62 applied to substrate 58. It is expected that current die handling equipment and micro device molding tools and techniques can be adapted to mold dies 12 as thin as 50 μm, with a length/width ratio up to 150, and to mold channels 16 as narrow as 30 μm. And, the molding 14 provides an effective but inexpensive structure in which multiple rows of such die slivers can be supported in a single, monolithic body.

Figure 17:
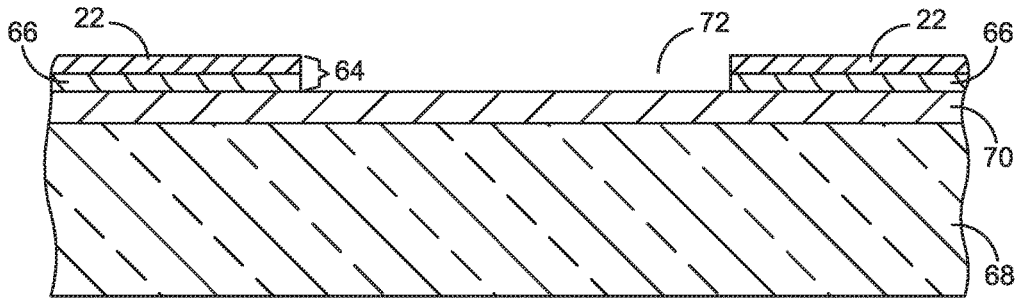
FIGS. 17-21 are section views illustrating one example of a process for making a new printhead die fluid flow structure.
Figure 18:
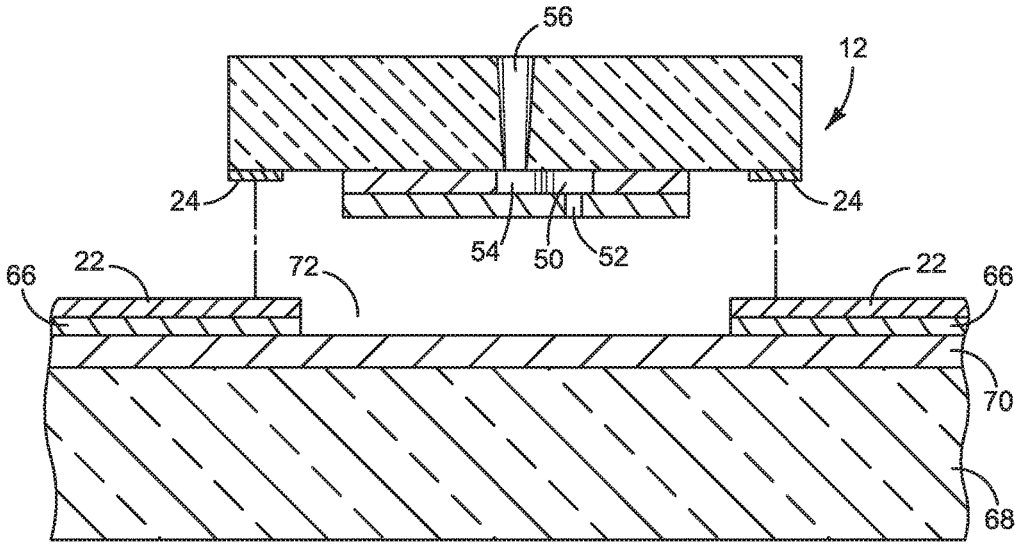
Figure 19:
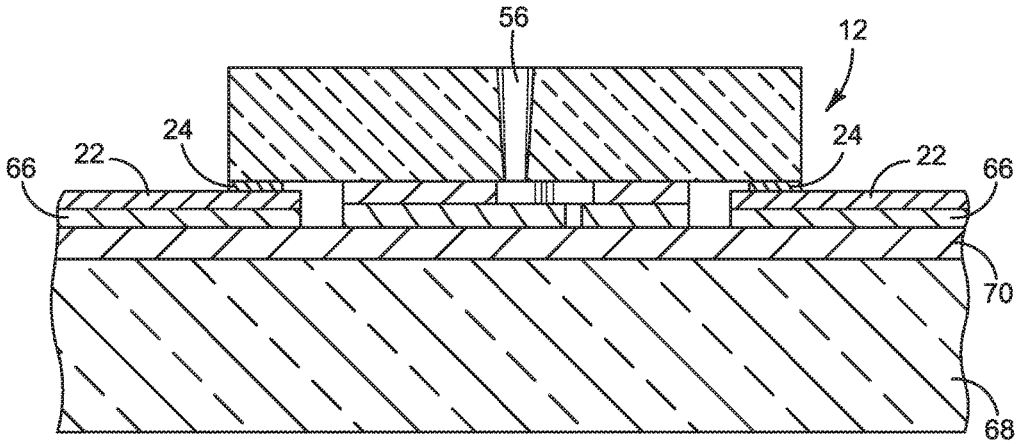
Figure 20:
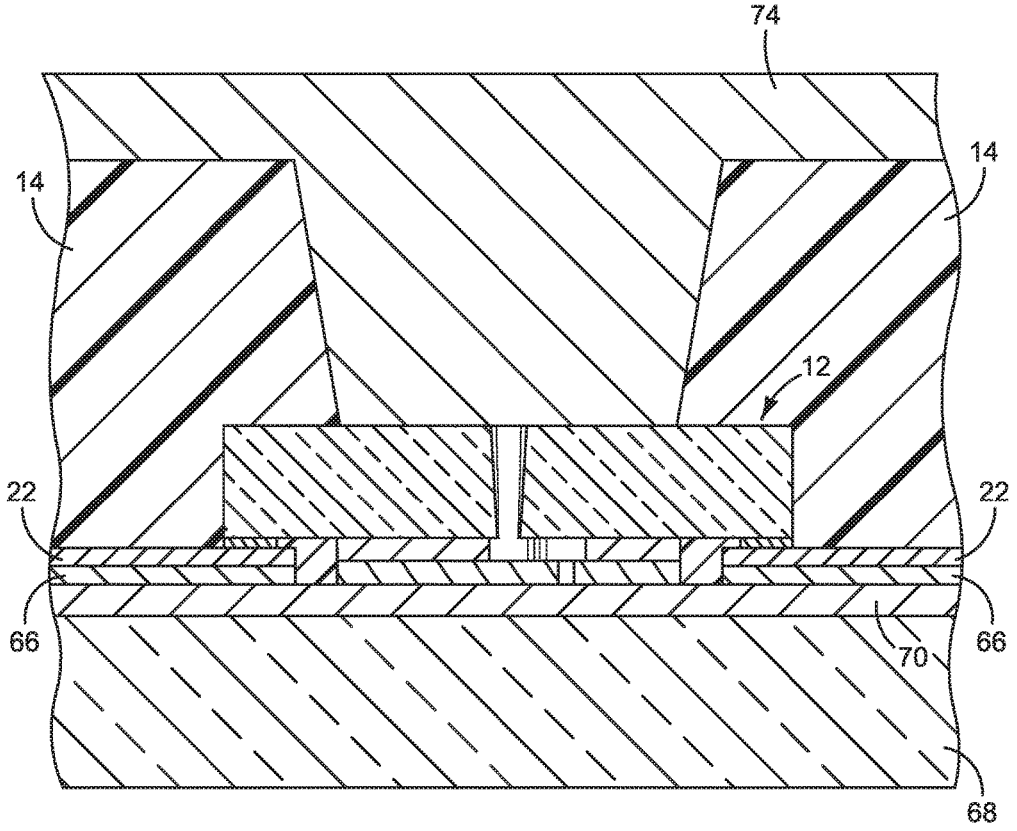
Figure 21:
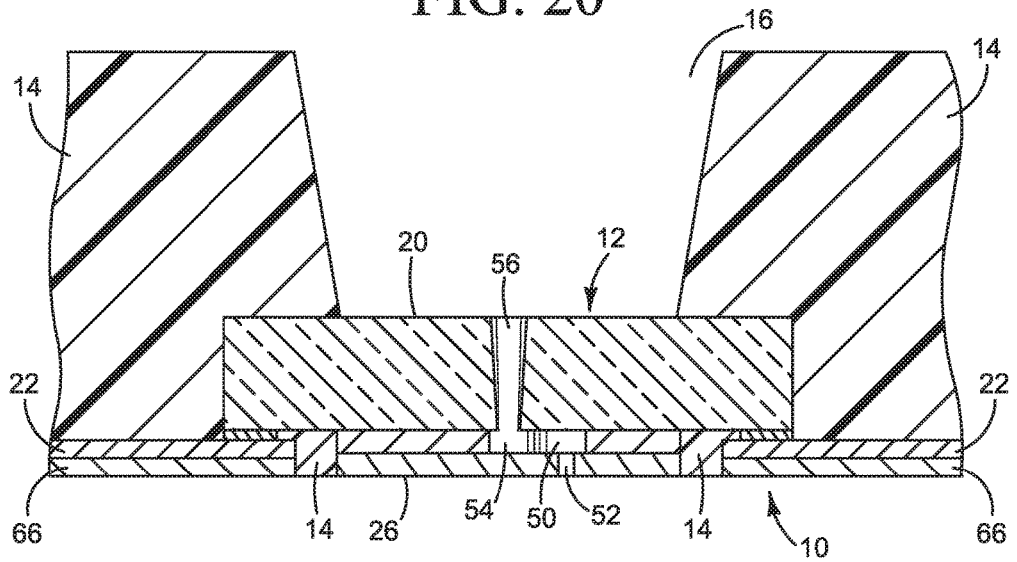
Figure 22:
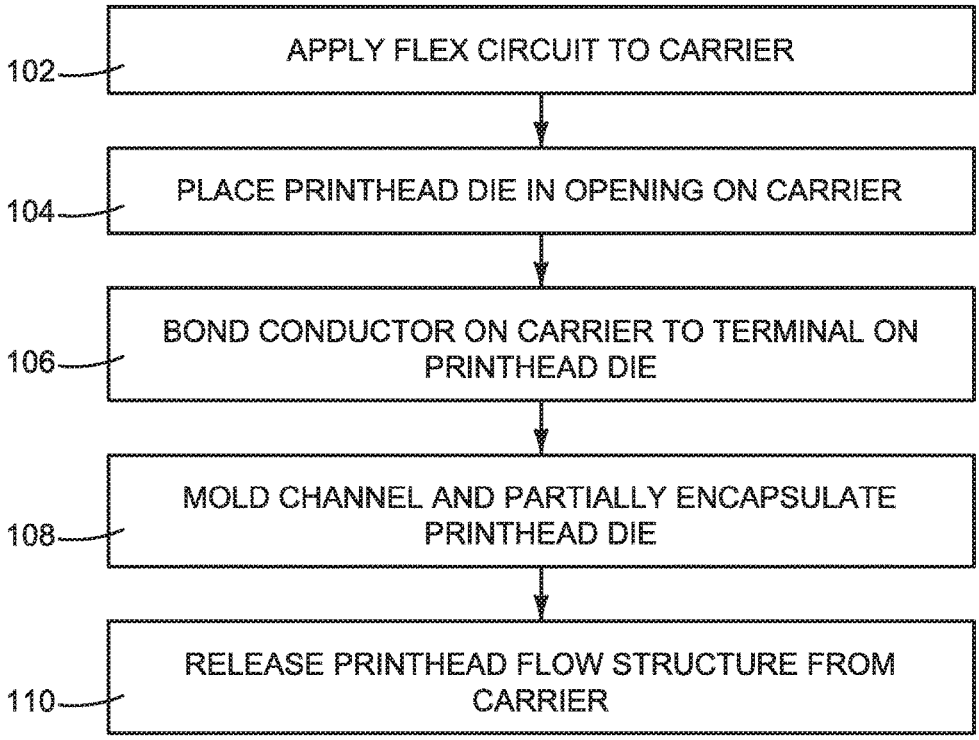
FIG. 22 is a flow diagram of the process shown in FIGS. 17-21.

FIGS. 17-21 illustrate one example process for making a new printhead fluid flow structure 10. FIG. 22 is a flow diagram of the process illustrated in FIGS. 17-21. Referring first to FIG. 17, a flex circuit 64 with conductive traces 22 and protective layer 66 is laminated on to a carrier 68 with a thermal release tape 70, or otherwise applied to carrier 68 (step 102 in FIG. 22). As shown in FIGS. 18 and 19, printhead die 12 is placed orifice side down in opening 72 on carrier 68 (step 104 in FIG. 22) and conductor 22 is bonded to an electrical terminal 24 on die 12 (step 106 in FIG. 22). In FIG. 20, a molding tool 74 forms channel 16 in a molding 14 around printhead die 12 (step 108 in FIG. 22). A tapered channel 16 may be desirable in some applications to facilitate the release of molding tool 74 or to increase fan-out (or both). After molding, printhead flow structure 10 is released from carrier 68 (step 110 in FIG. 22) to form the completed part shown in FIG. 21 in which conductor 22 is covered by layer 66 and surrounded by molding 14. In a transfer molding process such as that shown in FIG. 20, channels 16 are molded into body 14. In other fabrication processes, it may be desirable to form channels 16 after molding body 14 around printhead die 12.

Figures 23, 28:
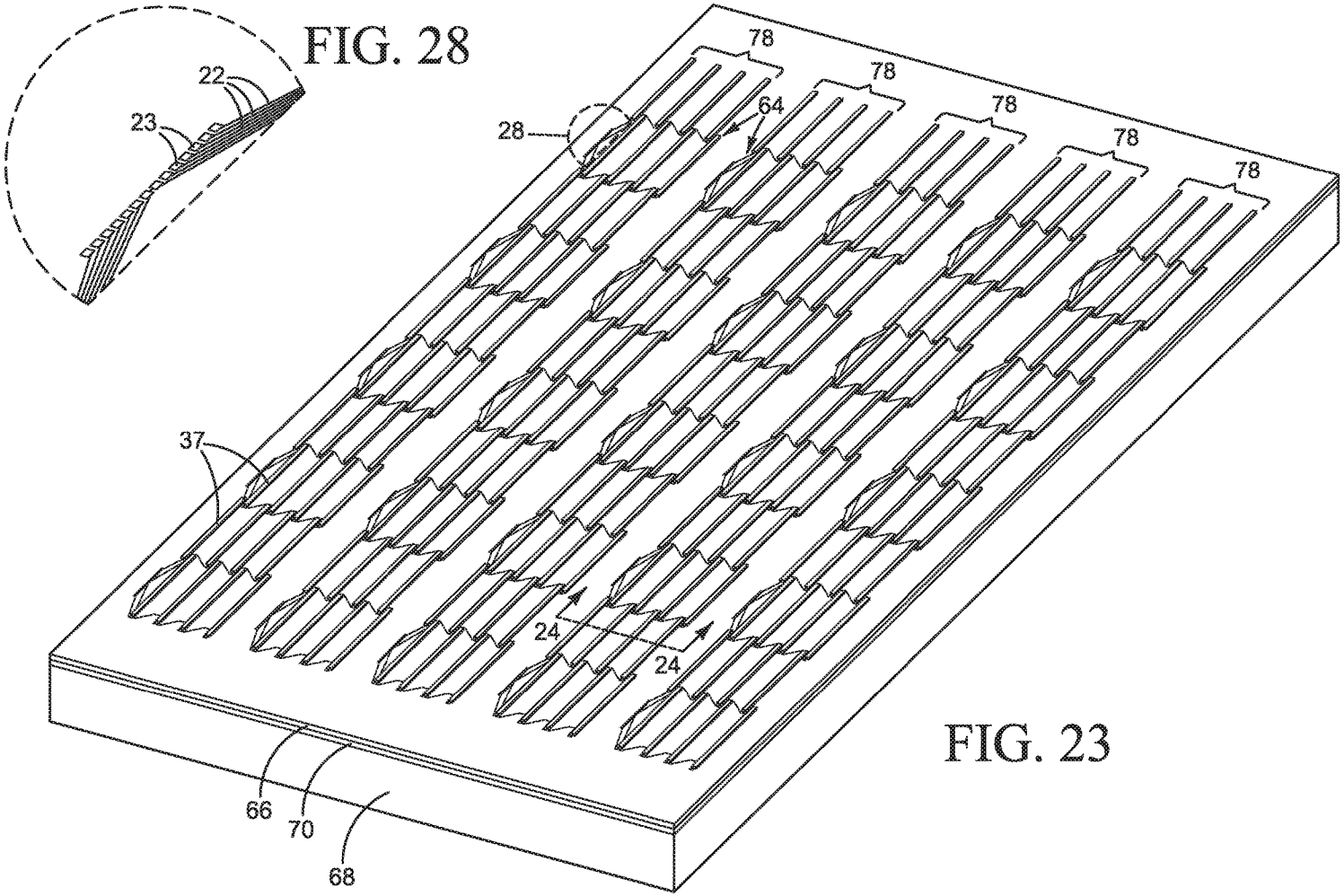
FIGS. 23-27 are perspective views illustrating one example of a wafer level process for making a new inkjet print bar such as the print bar shown in FIGS. 11-16.
FIG. 28 is a detail from FIG. 23.

While the molding of a single printhead die 12 and channel 16 is shown in FIGS. 17-21, multiple printhead dies and printing fluid channels can be molded simultaneously at the wafer level. FIGS. 23-28 illustrate one example wafer level process for making print bars 36. Referring to FIG. 23, printheads 37 are placed on a glass or other suitable carrier wafer 68 in a pattern of multiple print bars. (Although a "wafer" is sometimes used to denote a round substrate while a "panel" is used to denote a rectangular substrate, a "wafer" as used in this document includes any shape substrate.) Printheads 37 usually will be placed on to carrier 68 after first applying or forming a pattern of conductors 22 and die openings 72 as described above with reference to FIG. 17 and step 102 in FIG. 22.

In the example shown in FIG. 23, five sets of dies 78 each having four rows of printheads 37 are laid out on carrier wafer 66 to form five print bars. A substrate wide print bar for printing on Letter or A4 size substrates with four rows of printheads 37, for example, is about 230 mm long and 16 mm wide. Thus, five die sets 78 may be laid out on a single 270 mm×90 mm carrier wafer 66 as shown in FIG. 23. Again, in the example shown, an array of conductors 22 extend to bond pads 23 near the edge of each row of printheads 37. Conductors 22 and bond pads 23 are more clearly visible in the detail of FIG. 28. (Conductive signal traces to individual ejection chambers or groups of ejection chambers, such as conductors 22 in FIG. 21, are omitted to not obscure other structural features.)

Figure 24:
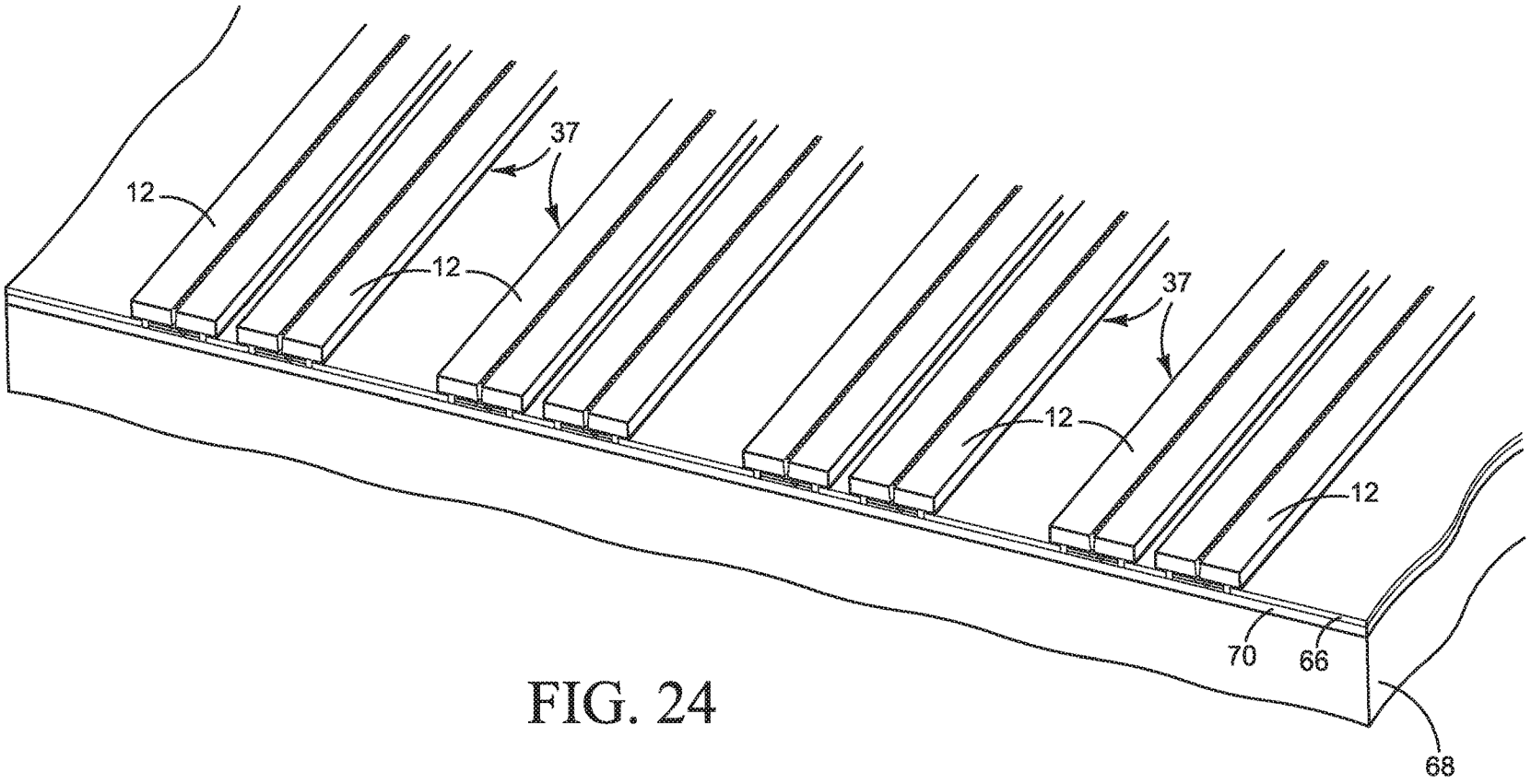
Figure 25:
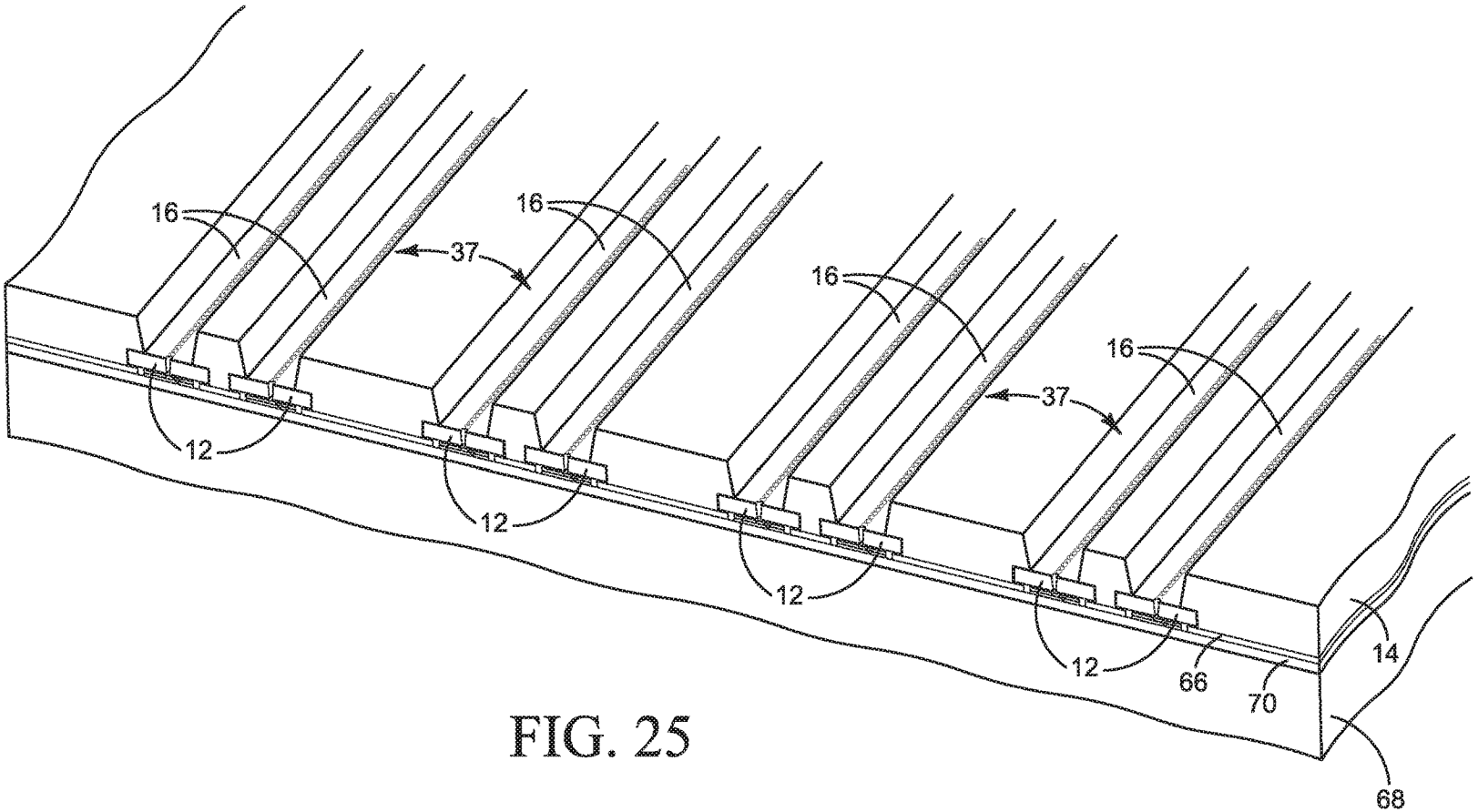
Figure 26:
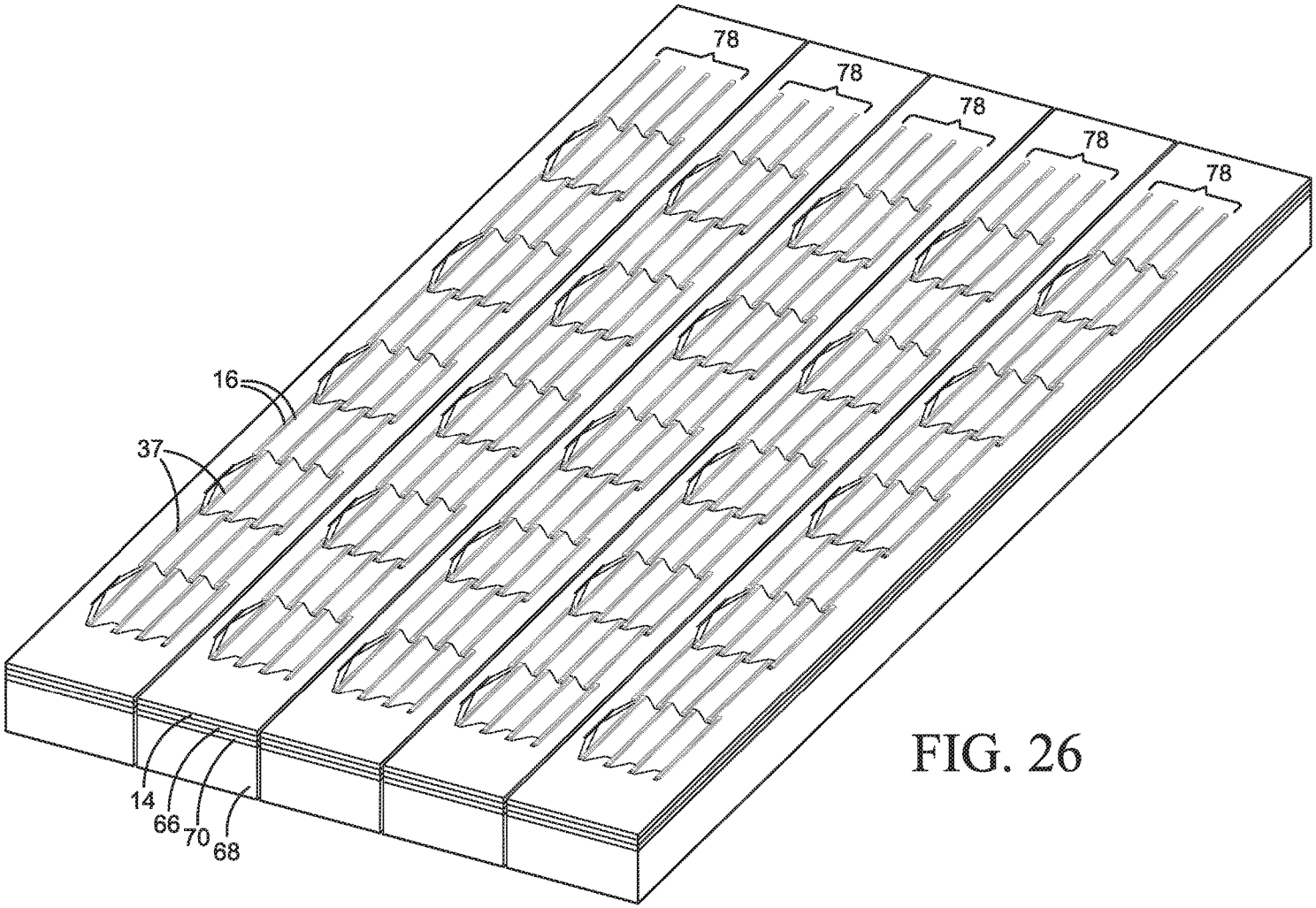
Figure 27:
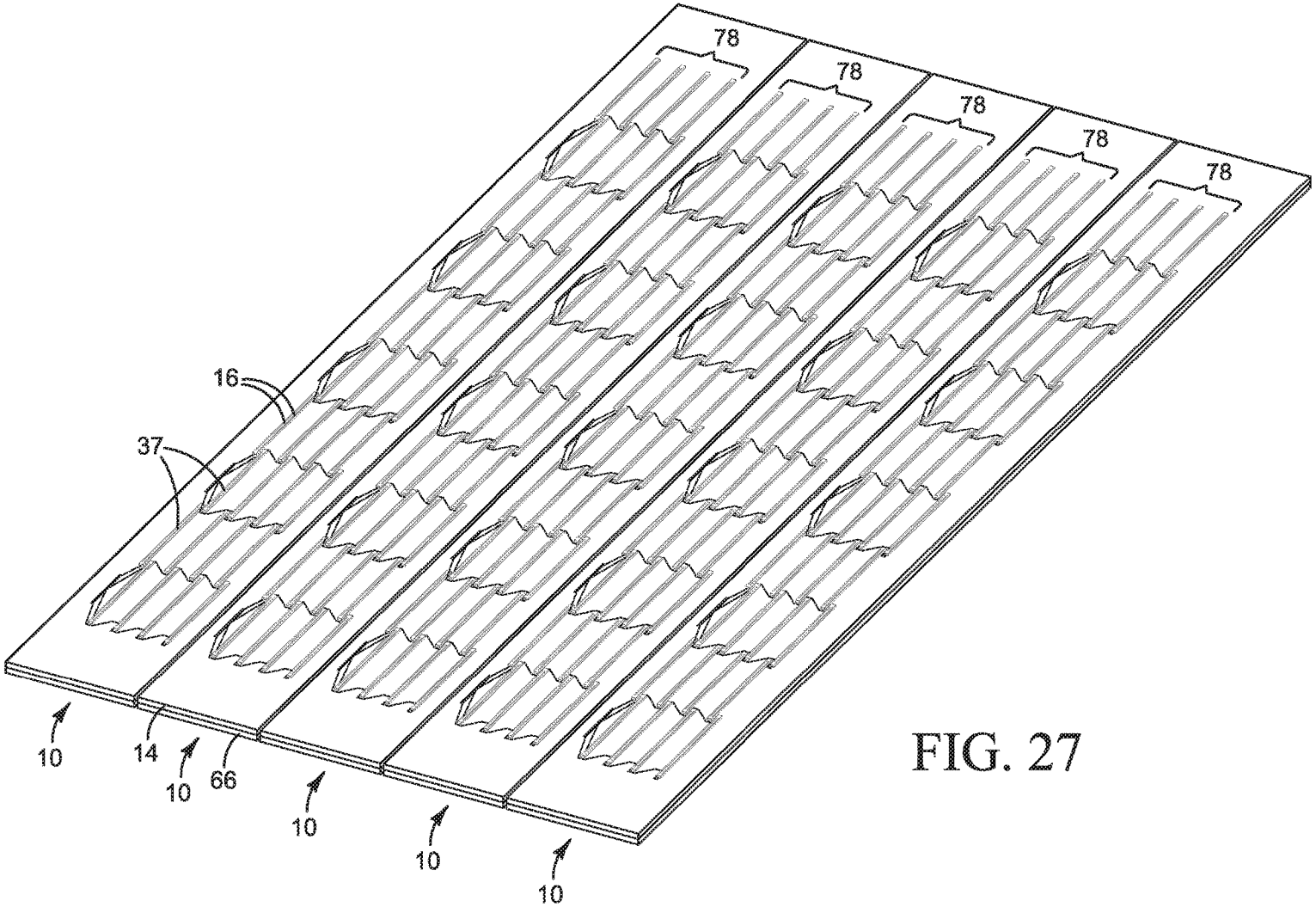

FIG. 24 is a close-up section view of one set of four rows of printheads 37 taken along the line 24-24 in FIG. 23. Cross hatching is omitted for clarity. FIGS. 23 and 24 show the in-process wafer structure after the completion of steps 102-112 in FIG. 23. FIG. 25 shows the section of FIG. 24 after molding step 114 in FIG. 23 in which body 14 with channels 16 is molded around printhead dies 12. Individual print bar strips 78 are separated in FIG. 26 and released from carrier 68 in FIG. 27 to form five individual print bars 36 (step 116 in FIG. 23). While any suitable molding technology may be used, testing suggests that wafer level molding tools and techniques currently used for semiconductor device packaging may be adapted cost effectively to the fabrication of printhead die fluid flow structures 10 such as those shown in FIGS. 21 and 27.

A stiffer molding 14 may be used where a rigid (or at least less flexible) print bar 36 is desired to hold printhead dies 12. A less stiff molding 14 may be used where a flexible print bar 36 is desired, for example where another support structure holds the print bar rigidly in a single plane or where a non-planar print bar configuration is desired. Also, although it is expected that molded body 14 usually will be molded as a monolithic part, body 14 could be molded as more than one part.

Figure 29:
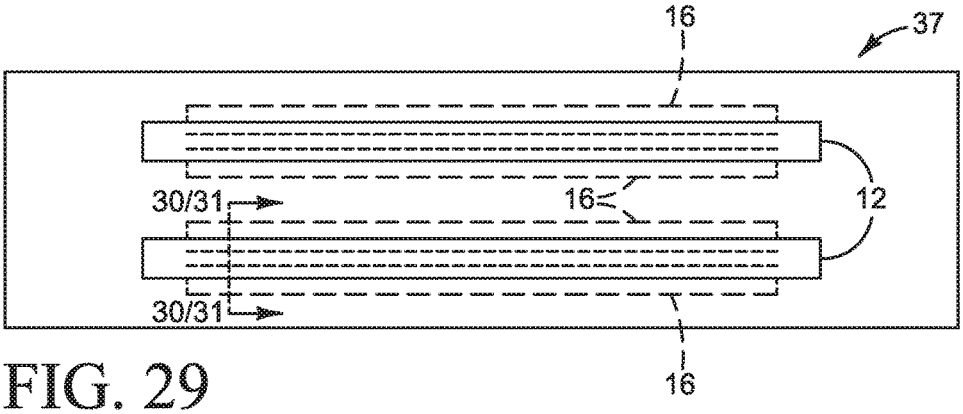
FIGS. 29-31 illustrate other examples of a new fluid flow structure for a printhead die.
Figure 30:
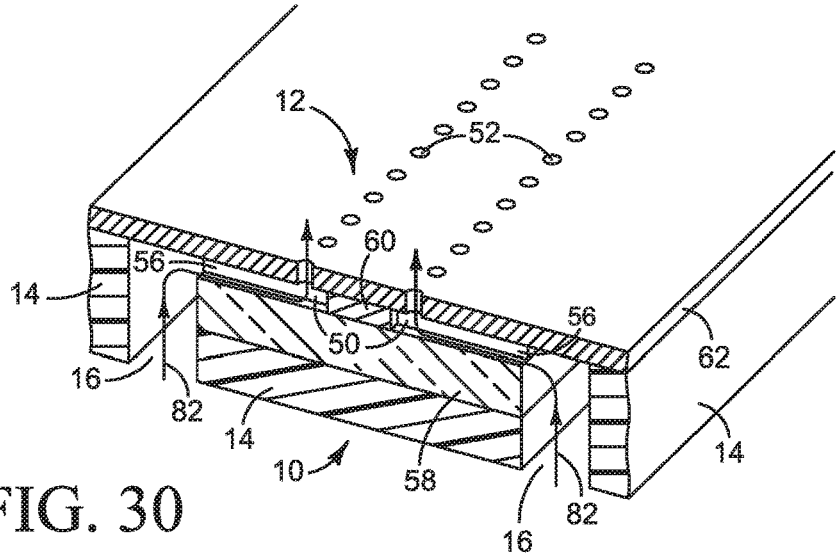
Figure 31:
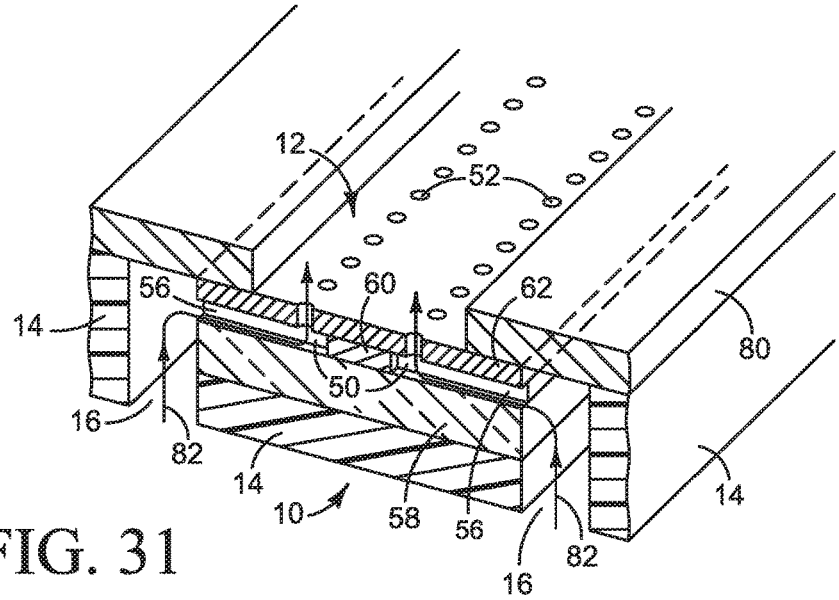

FIGS. 29-31 illustrate other examples of a new fluid flow structure 10 for a printhead die 12. In these examples, channels 16 are molded in body 14 along each side of printhead die 12, for example using a transfer molding process such as that described above with reference to FIGS. 17-21. Printing fluid flows from channels 16 through ports 56 laterally into each ejection chamber 50 directly from channels 16. In the example of FIG. 30, orifice plate 62 is applied after molding body 14 to close channels 16. In the example of FIG. 31, a cover 80 is formed over orifice plate 62 to close channels 16. Although a discrete cover 80 partially defining channels 16 is shown, an integrated cover 80 molded into body 14 could also be used.

As noted at the beginning of this Description, the examples shown in the figures and described above illustrate but do not limit the invention. Other examples are possible. Therefore, the foregoing description should not be construed to limit the scope of the invention, which is defined in the following claims.

What is claimed is:

1. A fluid flow structure, comprising:

a micro device molded into a monolithic molding, the molding comprising a channel therein through which fluid flows directly into the micro device, the micro device comprising:

a fluid flow passage connected directly to the channel;

a silicon substrate; and a fluid port formed in the silicon substrate and fluidically coupled to the channel, wherein the channel is wider than the fluid port, wherein the channel comprises an open channel exposed to an external surface of the micro device.

2. The fluid flow structure of claim 1, wherein the micro device comprises:

an electronic device that comprises an electrical terminal, and wherein the fluid flow structure comprises a conductor connected to the terminal and embedded in the molding.

3. The fluid flow structure of claim 2, wherein the electronic device comprises a printhead die sliver that comprises a fluid flow passage connected directly to fire channel.

4. The fluid flow structure of claim 3, wherein:

the monolithic molding is molded around a plurality of printhead die slivers, and fluid flows directly to the slivers through the channel.

5. The fluid flow structure of claim 4, wherein the channel comprises a plurality of channels through each of which fluid flows directly to at least one of the slivers.

6. The fluid flow structure of claim 4, wherein each printhead die sliver comprises a fluid flow passage connected directly to a channel.

7. The fluid flow structure of claim 1, wherein:

at least a second micro device is embedded into the monolithic molding, and the molding comprises at least a second channel through which fluid flows directly into the second micro device.

8. The fluid flow structure of claim 7, wherein the second channel contacts edges of the second micro device.

9. The fluid flow structure of claim 1, wherein the micro device comprises a monolithic or multi-layered orifice plate applied to the substrate.

10. The fluid flow structure of claim 1, wherein the micro device comprises an ejection chamber fluidically coupled to the fluid port.

11. The system of claim 10, wherein the micro device comprises:

a substrate;

an orifice plate coupled to the second side of the substrate;

a manifold fluidically coupled to the fluid port;

a number of fluid ejection chambers fluidically coupled to the manifold; and a number of orifices defined in the orifice plate and fluidically coupled to the fluid ejection chambers through which fluid is ejected from the micro device.

12. The fluid flow structure of claim 1, wherein the micro device is a printhead die having a thickness less than or equal to 650 μm.

13. The fluid flow structure of claim 1, wherein the fluid port is tapered.

14. A system, comprising:

a fluid source;

a micro device molded into a monolithic molding, the molding comprising a channel molded therein through which fluid flows directly into the micro device, the micro device comprising:

a fluid flow passage connected directly to the channel;

a silicon substrate; and a fluid port formed in the silicon substrate and fluidically coupled to the channel, wherein the channel is wider than the fluid port; and a pump to move fluid from the fluid source to the channel in the fluid flow structure, wherein the channel comprises an open channel exposed to an external surface of the micro device.

15. The system of claim 14, wherein:

the source of fluid comprises a supply of printing fluid, and the micro device comprises a printhead die.

16. The system of claim 14, wherein the micro device comprises an electronic device that comprises an electrical terminal, and the fluid flow structure comprises a conductor connected to the terminal and embedded in the molding.

17. The system of claim 14, wherein the micro device comprises a plurality of micro devices molded in the monolithic body, the monolithic body comprising a tapered channel molded therein through which fluid may flow directly to the slivers.

18. The system of claim 17, wherein the channel comprises multiple channels through each of which fluid may flow directly to one or more of the micro devices.

19. The system of claim 17, wherein each micro device comprises a fluid manifold connected directly to a plurality of fluid ports.

20. The system of claim 19, wherein each micro device comprises a silicon substrate in which the fluid manifold is formed.

* * * * *